US011167829B2

(12) United States Patent
Kalil

(10) Patent No.: US 11,167,829 B2
(45) Date of Patent: Nov. 9, 2021

(54) STAGGERED VESSEL TRANSOM FOR ATTACHMENT OF MULTIPLE ENGINES

(71) Applicant: Anthony Kalil, Palm City, FL (US)

(72) Inventor: Anthony Kalil, Palm City, FL (US)

( * ) Notice: Subject to any disclaimer, the term of this patent is extended or adjusted under 35 U.S.C. 154(b) by 116 days.

(21) Appl. No.: 16/577,829

(22) Filed: Sep. 20, 2019

(65) Prior Publication Data

US 2020/0115020 A1 Apr. 16, 2020

Related U.S. Application Data

(60) Provisional application No. 62/734,689, filed on Sep. 21, 2018, provisional application No. 62/791,488, filed on Jan. 11, 2019, provisional application No. 62/860,327, filed on Jun. 12, 2019.

(51) Int. Cl.
*B63H 20/06* (2006.01)

(52) U.S. Cl.
CPC ..... *B63H 20/06* (2013.01)

(58) Field of Classification Search
CPC ..... B63H 20/06
See application file for complete search history.

(56) References Cited

U.S. PATENT DOCUMENTS 4,813,365 A * 3/1989 Lindstrom ..... B63B 1/08 114/271
4,895,095 A * 1/1990 Potter, Jr. ..... B63H 20/02 114/343
10,202,179 B2 * 2/2019 Wong ..... B63H 20/06
2011/0232557 A1 * 9/2011 Kilgore ..... B63B 39/00 114/271

* cited by examiner

*Primary Examiner* — Stephen P Avila
(74) *Attorney, Agent, or Firm* — Saliwanchik, Lloyd & Eisenschenk

(57) ABSTRACT

A staggered engine mount transom that extends from the primary engine mount transom of a boat for increasing the number of outboard engines mounted on a boat. A transom extension can include one or more supports for a transom section to which the outboard engines can be mounted. Engines mounted on a transom and a transom section can have overlapping operating widths and closer propeller center lines of propulsion. A transom extension can also have one or more engine pods in which outboard engines can be mounted so that the engine operating widths further overlap and the center lines of propulsion are even closer together. This allows more outboard engines to be mounted on a boat than can be mounted on just a single plane transom.

20 Claims, 11 Drawing Sheets

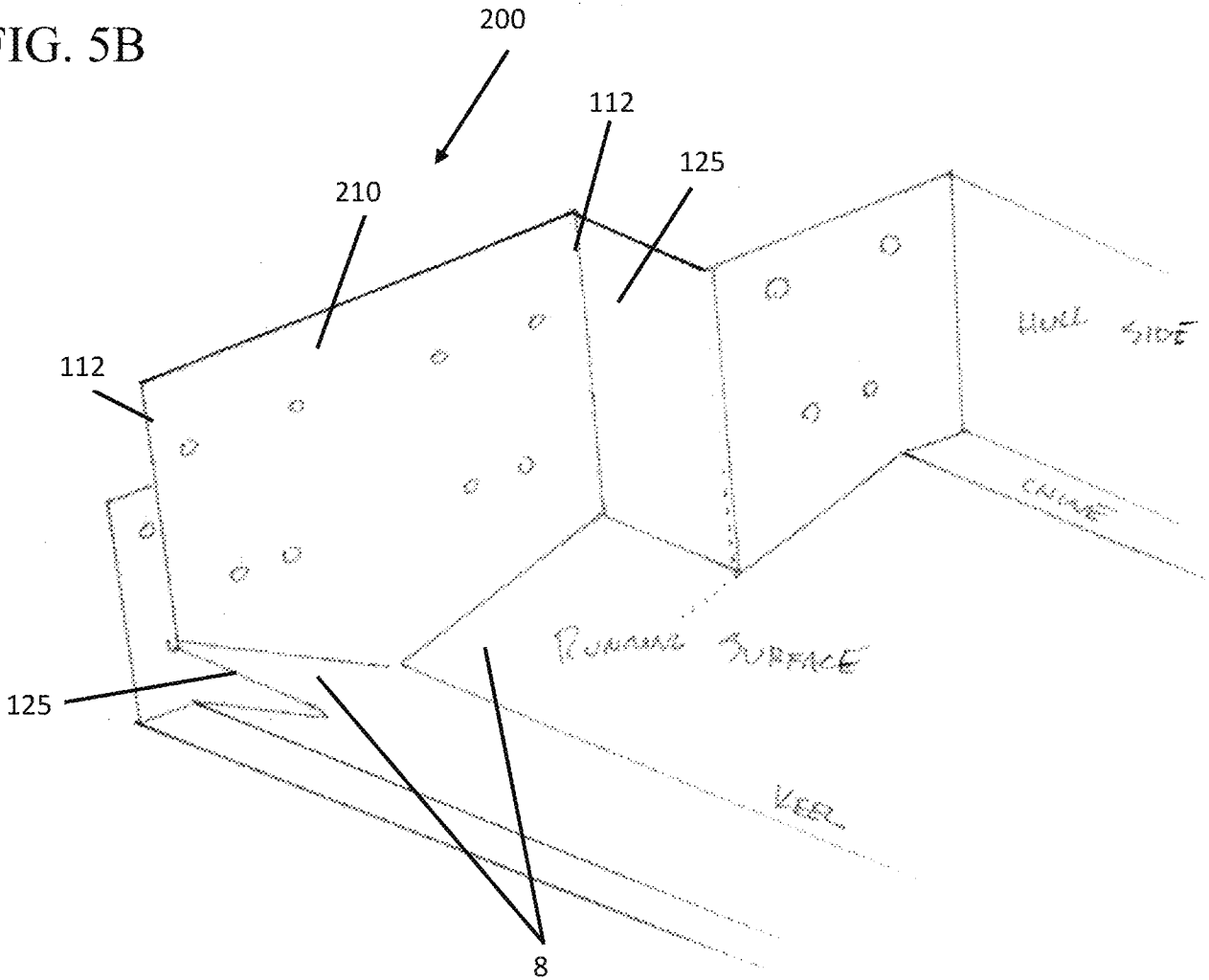
FIG. 5A
FIG. 5B
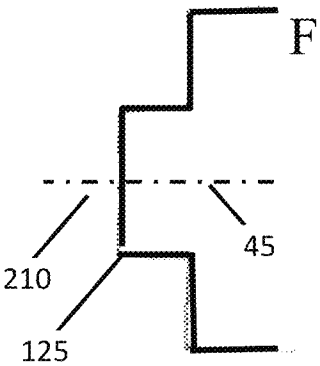

STAGGERED VESSEL TRANSOM FOR ATTACHMENT OF MULTIPLE ENGINES

CROSS-REFERENCE TO RELATED APPLICATIONS

This application claims priority to U.S. Provisional Application Nos. 62/734,689, filed Sep. 21, 2018; 62/791,488, filed Jan. 11, 2019; and 62/860,327, filed Jun. 12, 2019; all of which are hereby incorporated by reference in their entirety.

BACKGROUND OF INVENTION

Outboard engine powered boats are popular with boaters, particularly deep V-hull boats from 15 feet to 35 feet in length. They offer features that appeal to boaters, such as simplicity, weight savings over other types of powered boats, and the ability to tilt the outboard engines completely out of the water, which gives them anti-corrosion benefits over other types of boat engines.

Larger boats often employ two or more outboard engines, which are mounted in one plane, linearly side-by-side on the transom to either side of the keel or centerline of the boat. Originally, outboard powerheads were limited in available horsepower, due to technological limitations. Until only a few years ago, the maximum horsepower levels for most outboard engines did not exceed 300 horsepower. Recently, technological advancements, such as supercharging, fuel injection, and increased displacement, have allowed substantial amounts of horsepower to be designed into the newer outboard engines. These technological achievements have allowed outboards to surpass 625 horsepower per engine. As power levels have increased, the physical size of the engines has increased as well. This new availability of abundant horsepower in outboard form, has allowed boat manufacturers to design newer and larger types of boats that utilize these engines. Yachts up to 65 feet now employ the use of outboard engines, rather than the large diesel inboard engines that were the choice of manufacturers and customers alike. The use of the outboards allows greater top speeds and efficiencies than inboard power, due to the lack of underwater gear and rudders dragging through the water, and the ability to trim the engines up allows users to boat in shallower waters without the risk of damaging the underwater gear of inboard powered boats. Yachts are now commonly designed with 5 and six outboard engines at the transom of the boat. The only limitation to the amount of engines one can mount across the transom is the available width of the boat. Widening the boat to mount more engines is often not an applicable solution, as the increased width of the boat will increase the weight and drag of the hull significantly, and therefore negate the addition of the extra engines.

Typical outboard engines have a large powerhead that rises above the transom and is attached to an elongate housing that houses the gears and power transmission shafts that connect the propeller on the lower unit at the bottom of the housing. The powerhead, mid section gearcase housing and lower unit are vertically aligned, such that a straight vertical center line of the engine starts at the top of the powerhead and ends at the bottom of the lower unit.

The proximity of the engines mounted on the transom is limited by the size of the powerheads. The width of the transom should provide adequate clearance between the powerheads to minimize interference during operation and when the engines are rotated on their steering and tilt axes.

Designs are desirable that allow engines to be more compactly arranged on a boat, especially those that would allow a V-hull boat to carry more engines than can currently be placed in one plane, side-by-side on the transom. The result would be a V-hull boat with more power without having to widen the boat or transom in order to accommodate more engines.

BACKGROUND ART

Outboard engines have been mounted on extended transoms for many years. Armstrong style extension brackets, which are aluminum structures, are designed to hold 1 to 5 outboard engines. These brackets are sometimes bolted to standard transoms, in order to allow the engines to be farther aft, which allows the engines to be mounted higher in the water for less draft. Armstrong brackets are also utilized when a user wants to convert a hull that was previously powered by a different method of propulsion, such as a stern drive, where the hull was not designed with a proper splash well into the deck to accommodate the engine powerhead from tipping into the boat. By adding the Armstrong style transom extension, a user can convert a sterndrive type of boat without a splashwell in the deck, since the Armstrong extension is low enough and reaches aft far enough to allow the powerhead to tilt inwards without contacting the aft edge of the original hull. In all cases of Armstrong style extension brackets, all engines are mounted in the single plane of the bracket, and the original transom of the boat is no longer utilized to mount engines.

This invention differs significantly from the Armstrong style of bracket, as it is specifically designed to create at least two different engine mount transom planes, one in front of the other, in order to allow engines to be mounted on different transoms, and thereby more closely space the engines together.

BRIEF SUMMARY

In a boat embodying the principles of the invention, the transom is modified so that at least three engines can be mounted non-linearly on the boat, such that at least one engine is not in line with at least one other engine when viewed from the top view. More specifically, the boat is modified to have a staggered transom, for example with a secondary engine mount transom that extends aft of the boat primary engine mount transom, to provide a more aft transom section. The multiple engine mount transoms provide a staggered transom configuration, such that the boat has more than one engine mount transom plane. Outboard engines can be mounted on a staggered transom in a manner that places the centerlines of the engines closer than is possible when arranged in line on a single plane transom.

An outboard engine has an upper powerhead and a lower, narrower housing attached to a lower unit with the drive system. A center line drawn from the top of the powerhead to the bottom of the lower unit will appear to bisect the outboard engine. Outboard engines are attached to the transom, so that they can be tilted fore and aft to control the position of the lower unit, which is connected to the propeller and rudder fin. The engine mounting bracket, where the engine is mounted, is usually designed with an articulating bracket that holds the engine to the transom by way of two hinge points. These hinge points allow the engine to both tilt up and down (trim) and to steer left and right. When the engine is tilted up the powerhead leans forward or into the stern of the boat and the lower unit rises up in the water column or entirely out of the water. When the engine turns left or right, the powerhead also swings left and right and needs extra spacing to the sides to accommodate the engine turning. It is the sideways width of the powerheads that can dictate how close multiple engines can be mounted in line side by side on a transom.

With the subject invention, a staggered transom provides one or more engine mount transom sections aft of the primary stern engine mount transom of the boat. A staggered engine mount transom comprising a secondary engine mount extension can have a transom section with a mounting surface to which one or more outboard engines can be operably attached. Engines operably attached to the primary boat transom and the secondary transom section can have a staggered configuration, such that at least one of the engines is not in line on a single plane transom with two or more other engines on the boat. More specifically, the staggered transom configuration allows one or more engines to be positioned aft of at least one or more forward engines. Thus, the powerheads are not all side-by-side linearly on a single transom plane. This staggered arrangement of the engines allows the centerlines of two or more engines and the propeller center lines of propulsion to be closer together, without interfering with operation or the ability to tilt or turn any of the engines. Each transom can be further modified with one or more engine pods, which are indentations, cut-outs, or spaces in which an engine can be mounted to bring the engine centerlines even closer together and can also provide space for additional engines to be mounted on a boat, for example, even so close that the engine mounting brackets and engine cowlings can appear to be overlapped when viewed from directly behind the boat.

It should be noted that this Brief Summary is provided to generally introduce the reader to one or more select concepts described below in the Detailed Disclosure in a simplified form. This Summary is not intended to identify key and/or required features of the claimed subject matter. Other aspects and further scope of applicability of the present invention will also become apparent from the detailed descriptions given herein. It should be understood, however, that the detailed descriptions, while indicating preferred embodiments of the invention, are given by way of illustration only, since various changes and modifications within the spirit and scope of the invention will become apparent from such descriptions. The invention is defined by the claims below.

BRIEF DESCRIPTION OF DRAWINGS

In order that a more precise understanding of the above recited invention can be obtained, a more particular description of the invention briefly described above will be rendered by reference to specific embodiments thereof that are illustrated in the appended drawings. The drawings presented herein may not be drawn to scale, and any reference to dimensions in the drawings or the following description is specific to the embodiments disclosed. Any variations of these dimensions that will allow the subject invention to function for its intended purpose are considered to be within the scope of the subject invention. Thus, understanding that these drawings depict only typical embodiments of the invention and are not therefore to be considered as limiting in scope, the invention will be described and explained with additional specificity and detail through the use of the accompanying drawings in which:

FIGS. 5A and 5B illustrate the stern of a boat with one embodiment of a staggered transom. FIG. 5A is a starboard bottom perspective view and FIG. 5B represents a topside view of the stern showing an outline of the primary transom and the secondary transom extension. In this embodiment, the hull of the boat is incorporated into the running surface of the secondary transom extension.

FIG. 6A is a starboard bottom perspective view and FIG. 6B represents a topside view of the stern showing the outline of the staggered transom.

FIG. 7A is a starboard bottom perspective view. FIG. 7B represents a top side view showing the outline of the transom extension. FIG. 7C represents locations and proximity of outboard engines mounted on the primary boat transom and in an engine pod of the transom extension.

FIG. 8A is a starboard bottom perspective view. FIG. 8B represents a top side view showing the outline of the transom extension.

FIG. 9A is a starboard bottom perspective view and FIG. 9B is a topside view showing the outline of the transom extension.

FIG. 11A is a starboard bottom perspective view and FIG. 11B represents the locations and proximity of outboard engines mounted on the primary boat transom and in the portside secondary transom extension engine pod.

FIG. 12A is a starboard bottom perspective view and FIG. 12B represents outline of the transom extensions and the locations and proximity of outboard engines mounted on the primary boat transom and the secondary transom extensions.

DETAILED DISCLOSURE

Figure 1:
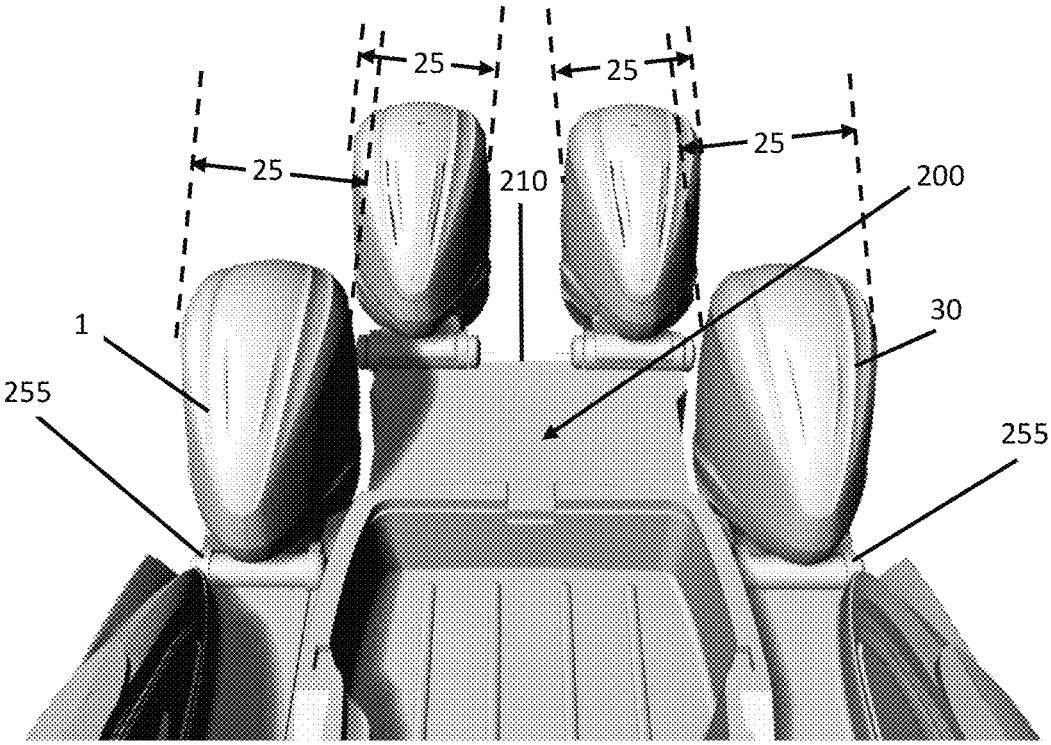
FIGS. 1, 2, 3, and 4 illustrate a representative example of a boat with a staggered transom. It can be seen in these Figures that outboard engines mounted on a staggered transom can have overlapping engine cowling operating widths.
Figure 2:
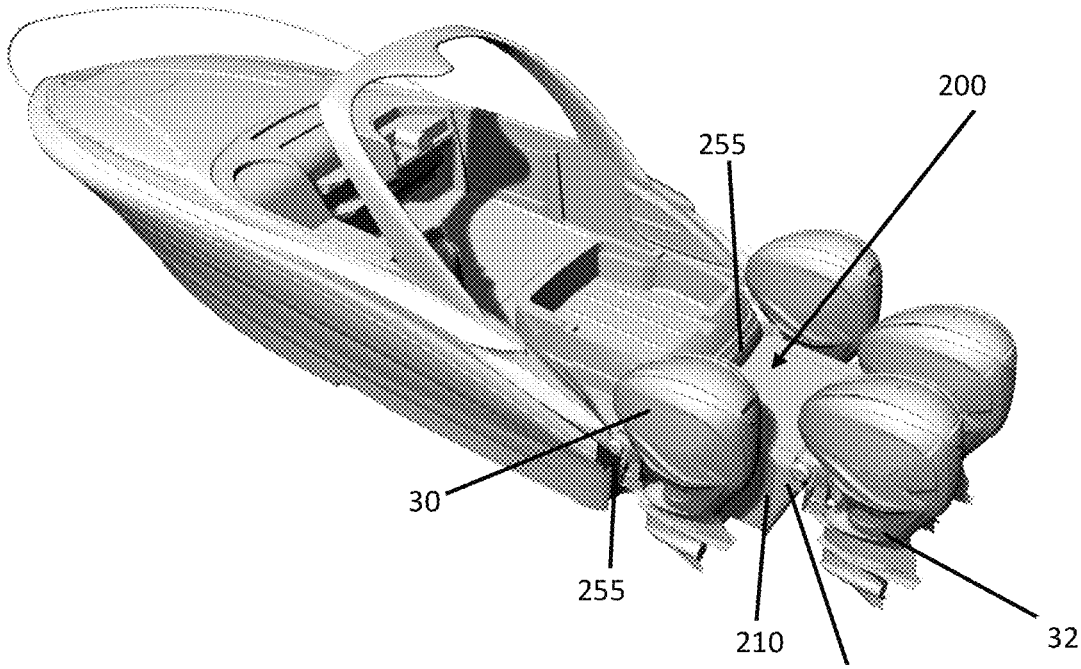
Figure 3:
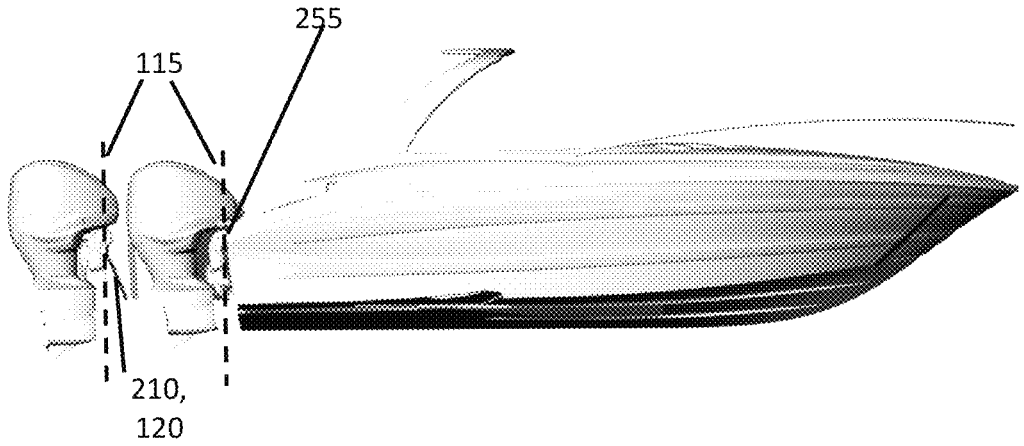

The subject invention pertains to a modified boat transom. More specifically, the subject invention provides one or more embodiments of a staggered engine mounting transom design that provides a boat with an additional engine mount transom section aft of the primary boat stern engine mount transom. An extended engine mount creates a staggered transom, such that the boat has more than one engine mount transom, and thus more than one engine mount transom plane. With embodiments of the staggered transom, three or more outboard engines can be mounted non-linearly in a stepped or staggered configuration on a boat when viewed from above. Other embodiments allow for the engine center lines and the propeller center lines of propulsion to be closer together than is typically possible on a boat, allowing more horsepower to be utilized on a given width hull.

The following description will disclose that the subject invention is particularly useful on all boats that have a beam from 7 feet to 16 ft. or greater and are powered with outboard engines. However, a person with skill in the art will be able to recognize numerous other uses to which the subject invention would be applicable. While the subject application describes, and many of the terms herein relate to boats that employ outboard engines with propellers, other modifications apparent to a person with skill in the art and having benefit of the subject disclosure are contemplated to be within the scope of the present invention.

In the description that follows, a number of terms are used that relate to boats and outboard engines. In order to provide a clear and consistent understanding of the specification and claims, including the scope to be given such terms, the following definitions are provided.

The term "outboard engine" or "engine" as used herein describes a self-contained motor that can be mounted on the transom at the stern of a boat that provides a thrust that propels the boat in the opposite direction. Thrust mechanisms can be propeller or jet driven. A standard outboard engine has an upper powerhead attached to a housing above some type of lower unit where the thrust mechanism is located.

A "transom plane," as used herein, refers to a plane that includes an engine mount transom or transom section of a transom extension and usually is substantially perpendicular to the port and starboard sides of the hull. Thus, a boat engine mount transom plane can be more forward than the transom plane of an engine mount transom extension.

With reference to an outboard engine, the "operating width" is the side-to-side (a.k.a., port to starboard) distance of the engine cowling or the distance that an engine powerhead requires on a transom in order to tilt and rotate on the mounting surface. The powerhead is typically longer in the forward to aft direction than it is wide in the port to starboard. When an engine is straight on the transom (the direction of thrust or propulsion is perpendicular to the transom) the operating width is the width of the cowling that covers the engine powerhead. When the engine is rotated to port or starboard, such as during turning operation, the operating width increases as the aft side furthest from the engine mount transom plane end of the powerhead rotates from side to side.

Also, as used herein and unless otherwise specifically stated, the terms "operable communication," "operable connection," "operably connected," "operably attached," "cooperatively engaged" and grammatical variations thereof mean that the particular elements are connected in such a way that they cooperate to achieve their intended function or functions. The "connection" or "engagement" may be direct or indirect, physical or remote.

It is to be understood that the drawings and descriptions of embodiments of the present invention have been simplified to illustrate elements that are relevant for a clear understanding of the invention, while eliminating, for purposes of clarity, other elements that may be well known. Those of ordinary skill in the art will recognize that other elements may be desirable and/or required in order to implement the present invention. However, because such elements are well known in the art, and because they do not facilitate a better understanding of the present invention, a discussion of such elements is not provided herein.

Finally, the nautical terms herein, such as "forward," "aft," "port," "starboard," "stern," "hull," "beam," and "centerline" are used herein according to their common and well-known meanings. As such, the figures herein do not include reference numbers for such terms.

The present invention is more particularly described in the following examples that are intended to be illustrative only because numerous modifications and variations therein will be apparent to those skilled in the art. As used in the specification and in the claims, the singular for "a," "an," and "the" include plural referents unless the context clearly dictates otherwise.

Reference will be made to the attached Figures on which the same reference numerals are used throughout to indicate the same or similar components. With reference to the attached Figures, which show certain embodiments of the subject invention, it can be seen that the subject invention comprises an engine mount transom extension 200 that extends from or aft of the engine mount transom 255 of a boat for supporting thereon one or more outboard engines 1. The transom extension can have a transom section 210 that defines a transom plane 115. Each transom section can have a mounting surface 120, to which an outboard engine 1 is mounted, and one or more supports 125. The supports can be modified as one or more engine pods 250 in which an engine housing can be positioned with the engine cowling above the engine pod. Alternative embodiments can include more than one transom extension. Each of these general components can have one or more sub-components, which will be discussed in detail below.

Figure 4:
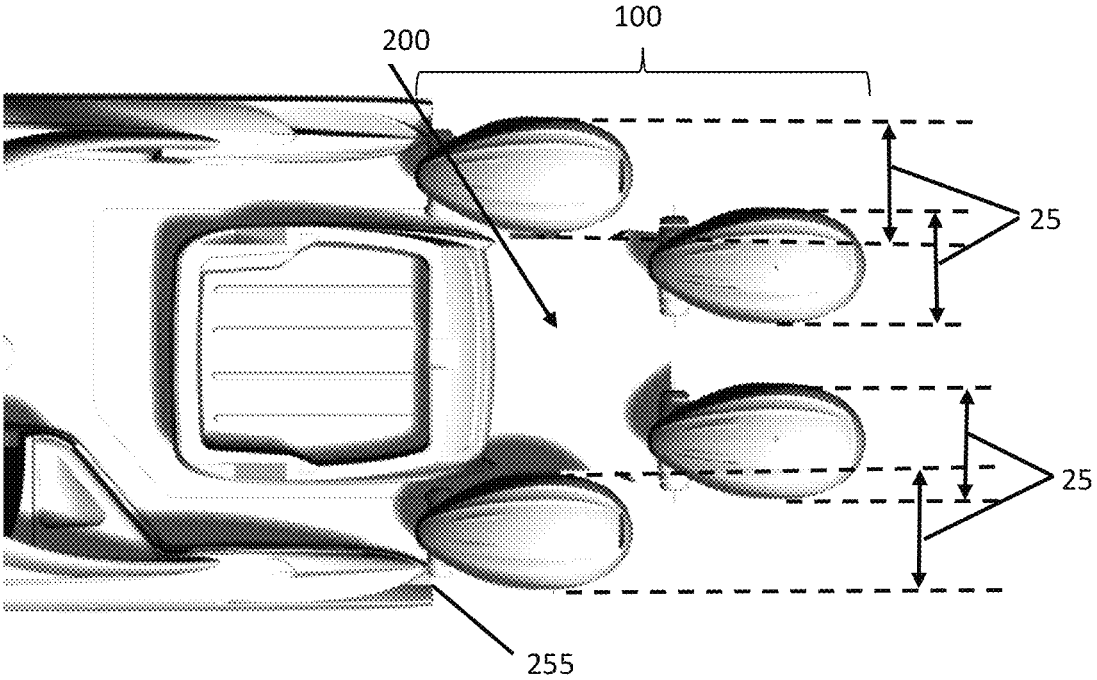

FIGS. 1-4 illustrate stylized examples of a boat with a transom extension 200, according to the subject invention. A transom extension allows for a staggered or non-linear arrangement of outboard engines 1, where at least one engine is more aft of at least one other engine. In the example shown in FIGS. 1-4, two engines are mounted on the transom 255 and two other engines are mounted aft of, and closer to the centerline 45 than, the engines mounted on the transom. Thus there is a pair of engines 100 at each of the port and starboard sides, such as shown in FIG. 4. This staggering of the engines can allow the operating widths 25 of the cowling 12 over the powerheads 30 to overlap, as shown, for example, in FIGS. 1 and 4. It can also conserve space, which allows for mounting of additional engines that would not be possible if the engines were in line side-by-side on the engine mount transom 255. The examples in FIGS. 1-4 illustrate how space is created between four engines by staggering the engines with a transom extension. On a boat that previously could support only four engines, for example, transom extensions according to the subject invention can allow five, six, or more engines to be mounted to the boat.

A transom extension 200 can have a transom section 210 with a mounting surface 120 to which an engine can be mounted. For example, the mounting surface can have a mounting plate to which the mounting bracket of an engine can be attached, such as shown for example, in FIG. 6A. Outboard engines can weigh several hundred pounds. In one embodiment, the transom section is reinforced to support the weight and operation of one or more outboard engines. In a further embodiment, the transom 255 is reinforced to support the transom extension and outboard engines mounted thereon.

In one embodiment, a transom section 210 has a width 111 that is at least 1 ft., 1.5 ft, 2 ft, 2.5 ft., 3 ft., 3.5 ft, 4 ft., 4.5 ft., 5 ft., 5.5 ft, 6 ft., 6.5 ft., 7 ft., 7.5 ft., 8 ft., 8.5 ft., 9 ft., 9.5 ft., 10 ft., 10.5 ft., 11 ft., 11.5 ft., 12 ft., 12.5 ft., 13 ft., 13.5 ft., or 14 ft., or a width greater than or in a range between any two of the listed values. The width 111 of a transom section 210 can depend upon the engine mount transom width 43 of a boat and the number of engines to be supported on each. For example, the transom section 210 can be configured to support fewer engines than are supportable on the primary engine mount transom 255. In another example, the transom section can support the same number or more engines than are supportable on the primary engine mount transom 255. Thus, a transom section 210 can have a width 111, between the port and starboard sides, that is less than the total width 43 of the transom 255, such as shown, for example, in FIGS. 9A and 9B. Alternatively, the transom section 210 can have a width that is greater than the total mountable width of a transom, such as shown, for example, in FIGS. 7A and 7B.

Figures 6A, 6B:
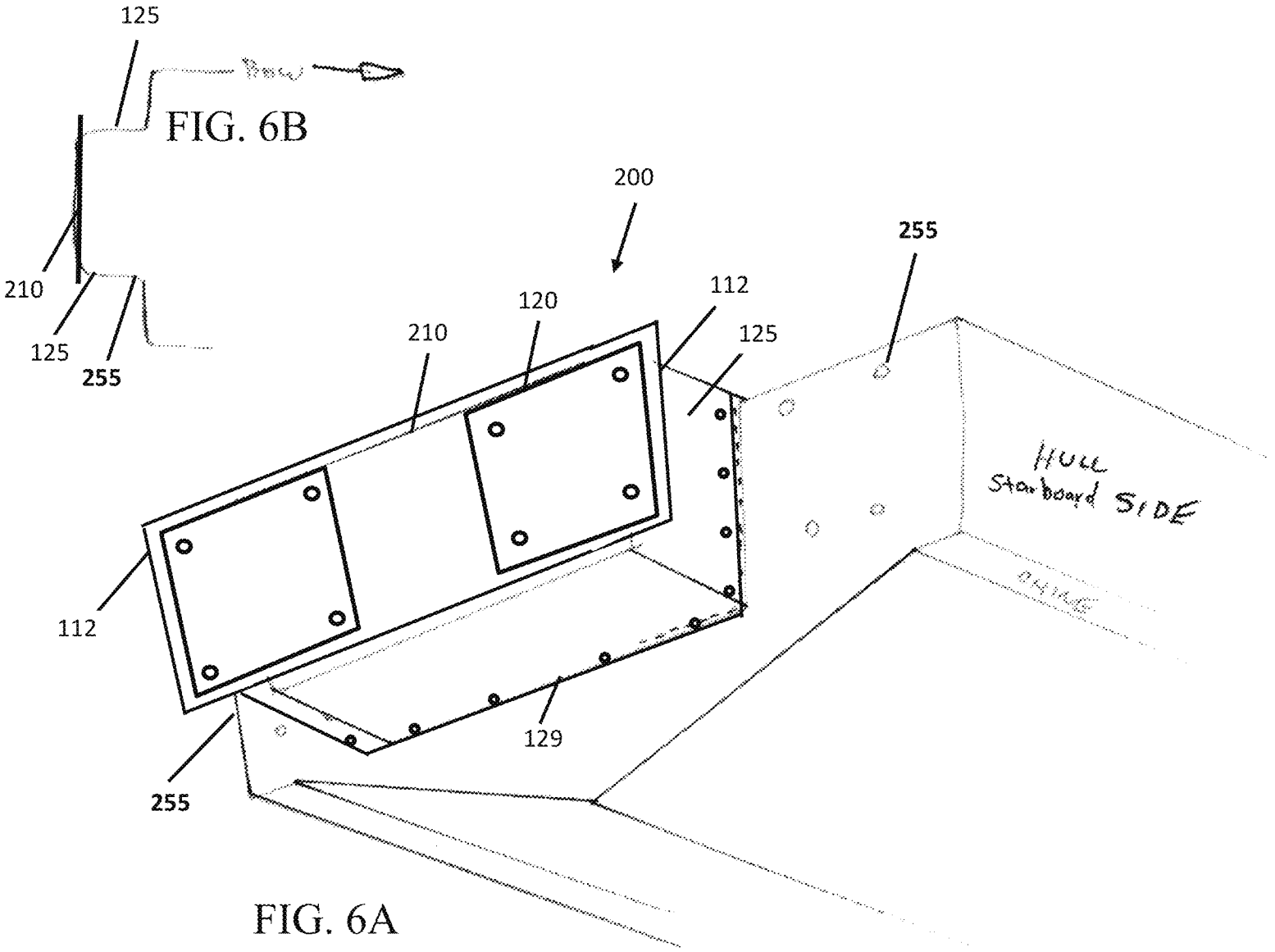
FIGS. 6A and 6B illustrate the stern of a boat with another embodiment of a staggered transom. In this embodiment, the transom section overlaps the transom supports. Also shown is an attachment mechanism, in the form of a flange, for operably attaching the transom extension to a boat transom.

The transom section 210 is secured to and extends from the primary transom 255, by one or preferably by two or more supports 125. The supports can also be configured and reinforced to support the transom section and the weight of one or more engines mounted thereon, as well as other loads placed thereon when the boat is in motion. The supports can be placed at or near the port and starboard sides of the transom section 210 or at each side 112 of a transom section, as illustrated, for example, in FIGS. 5A, 5B, and 10. FIGS. 6A and 6B illustrate an alternative where the supports 125 are set-in from the port and starboard ends of the transom section, such that the transom section overlaps the transom supports. Thus, it will be understood that the supports can vary in their location relative to the transom section, based on a variety of factors, known to those with skill in the art. Thus, variations in the position of a support 125 that provides the same function for a transom section 210 are within the scope of the subject invention.

Figure 9A:
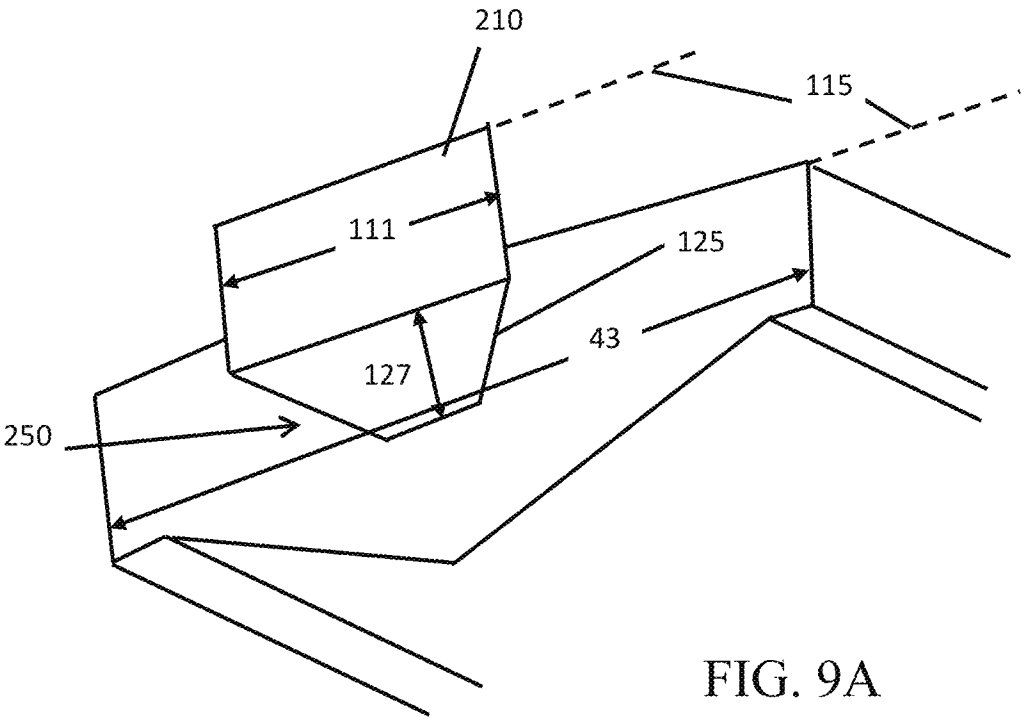
FIGS. 9A and 9B illustrate an embodiment of a staggered transom where the attachment of the supports to the transom is narrower than the width of the transom section to provide an engine pod.
Figure 9B:
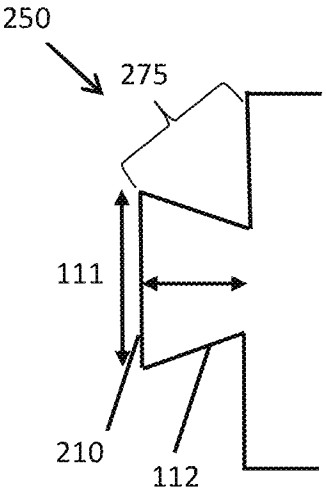
Figure 10:
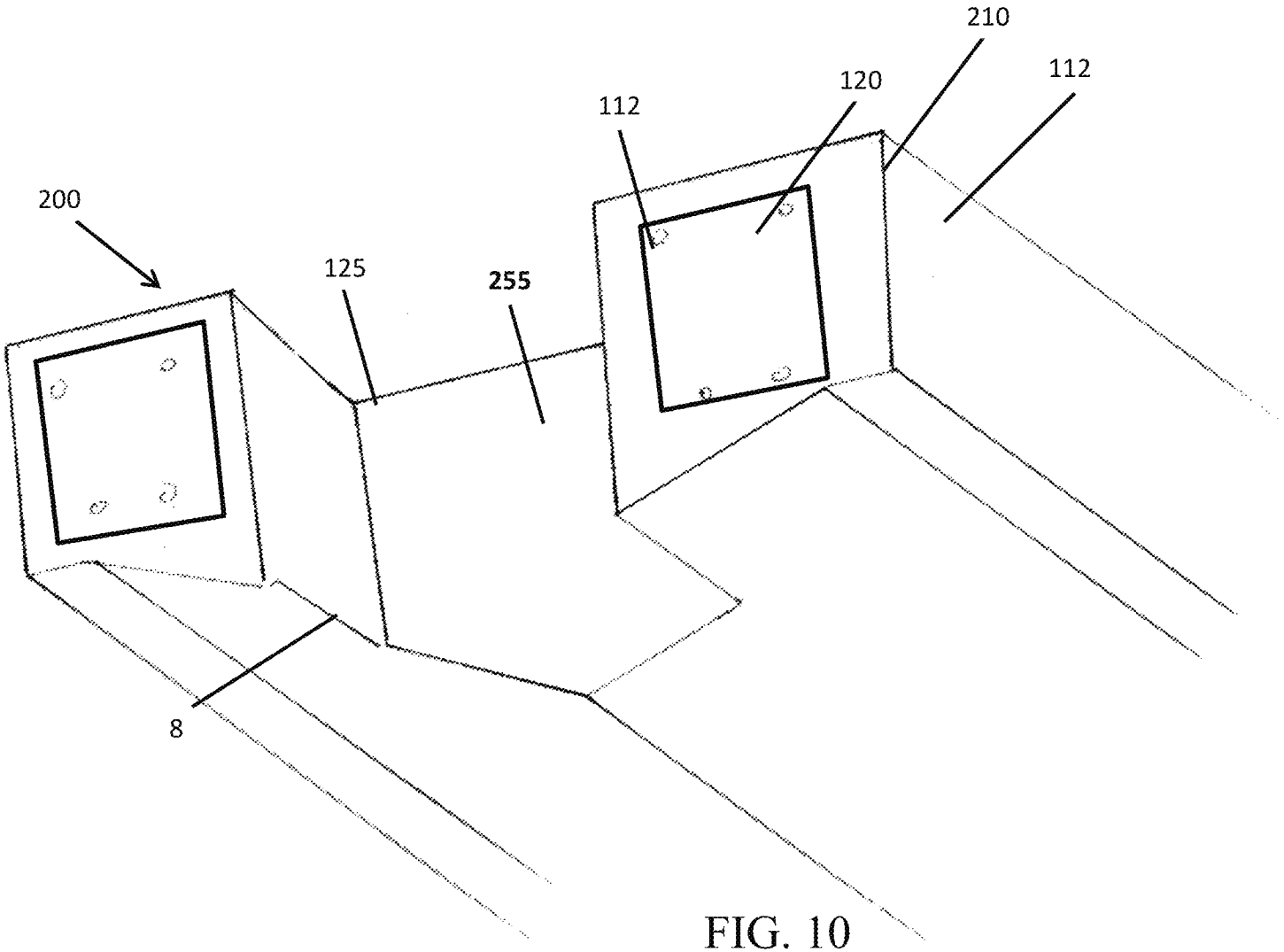
FIG. 10 illustrates an embodiment with two transom extensions from the transom of a boat. In this embodiment, the hull of the boat is incorporated into the running surface of the transom extensions.

Likewise, the supports 125 can have a length 127, which is the distance between where the supports extend from the transom 255 to where they connect to the transom section 210, as illustrated by way of example in FIGS. 9A, 9B, and 10. In one embodiment, a support has a length of at least 2 ft., 2.5 ft., 3 ft., 3.5 ft., 4 ft., 4.5 ft., and 5 ft or a length greater than or in a range between any two of the listed values. As mentioned above, outboard engines can tilt forward and aft to raise their lower unit. Typically, the mounting bracket on an outboard engine is located on the housing 32, so that the fulcrum of the engine tilt is below the powerhead 30. This allows the powerhead to tilt forward simultaneously with the lower unit being raised. To accommodate this forward tilt of the powerhead, an engine operably attached to the transom section requires the one or more supports have sufficient length to accommodate the powerhead tilting at least partially over the transom extension.

A transom extension can be integral with the boat structure, in that it is built as part of the boat structure at the time of manufacture. Alternatively, a transom extension can be an add-on component, such that it can be operably attached to a boat after the boat is manufactured. In one embodiment, the transom extension can be operably attached to the primary transom 255 of the boat by any means known to those with skill in the art. For example, the supports 125 can be bolted onto the transom. Transoms are heavily reinforced to support the weight of outboard engines. A support can be bolted onto the transom through the external hull and into one or more of transom reinforcements. Alternatively, a portion of the hull can be removed so that the transom can be attached directly to one more transom reinforcements. In one embodiment, the one or more supports 125 can have one or more attachment mechanisms that extend from the supports to facilitate attachment to the transom. FIG. 6A illustrates a non-limiting example of an attachment mechanism in the form of a flange 129 that can be bolted to a primary transom for attachment of a secondary engine mount transom extension. Additional structural details can be added, such as fiberglass and gelcoat, to provide additional support and/or conceal the attachment mechanism.

Figures 11A, 11B:
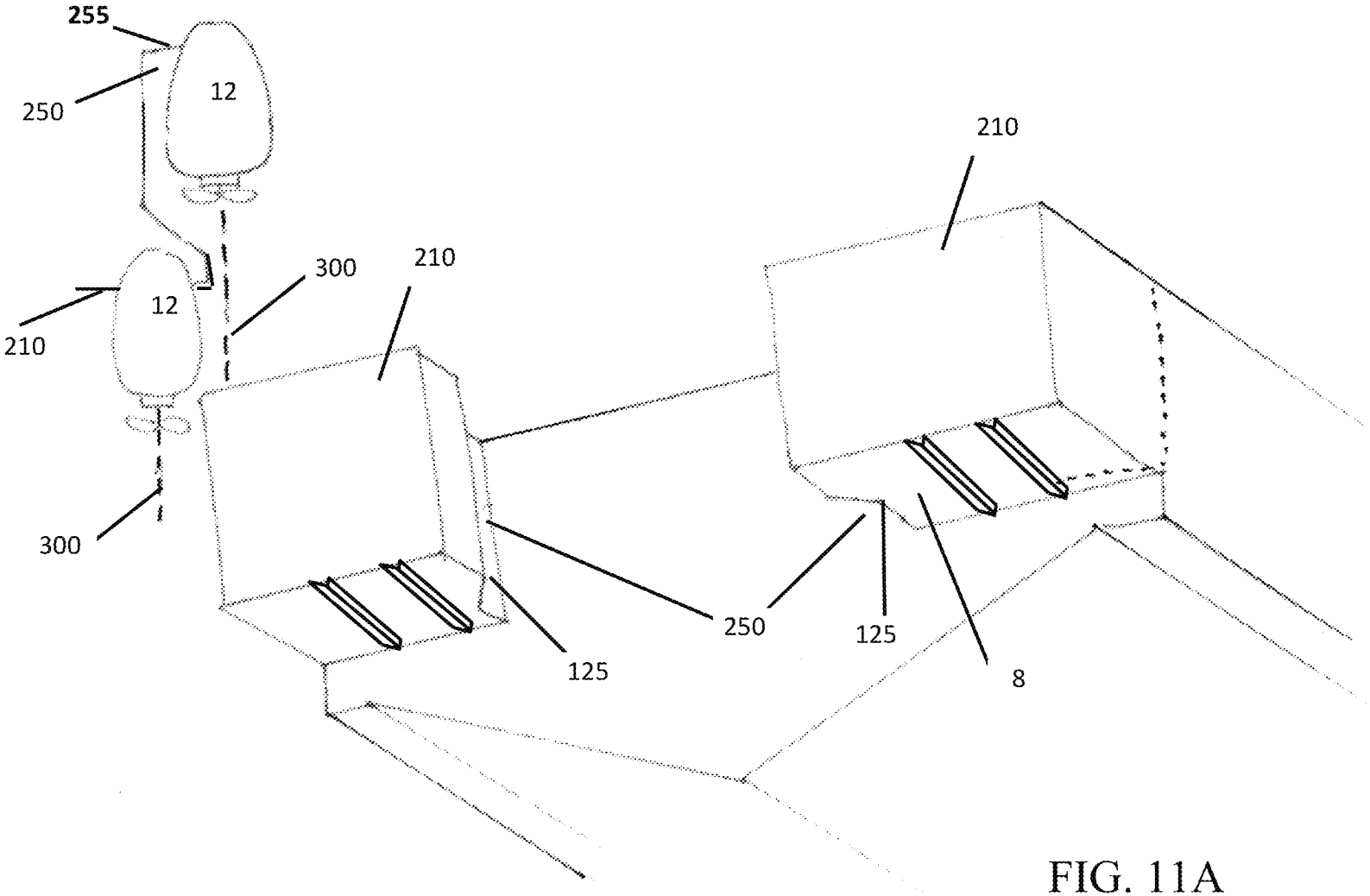
FIGS. 11A and 11B illustrate another embodiment with two transom extensions from the transom of a boat, where the extensions do not extend the hull bottom (running surface).

When a boat is in motion, water from the hull causes a wake behind the boat. In one embodiment, a secondary transom extension 200 has a running surface 8 beneath the transom section 210 and supports 125 to direct the wake water downwards and inhibit drag on the transom extension. In one embodiment, the running surface is flat and deflects water as the water moves over the running surface. FIGS. 6A, 7A, 9A, and 11A illustrate embodiments of a flat running surface. In an alternative embodiment, the running surface has extended surface features 135 that channel water over the running surface. FIG. 11A shows one example of a running surface with extended surface features. In specific embodiment, the running surface is incorporated with or is integral with the hull of the boat and includes features to channel water as it passes the transom extension. FIGS. 5A, 8A, 10, and 12A illustrate non-limiting examples of transom extensions 200 with running surfaces 130 that are integral with the hull, forming a continuous surface.

In one embodiment, a single secondary engine mount transom extension 200 is arranged on a boat. In a further embodiment, the secondary transom extension is centered on the transom. FIGS. 5A and 5B show a non-limiting example of this embodiment. In an alternative embodiment, the secondary transom extension is off-center on the transom, which is not shown in the Figures, but is understood by a person of skill in the art.

Figure 12B:
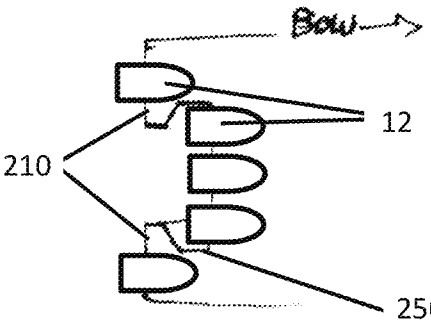
FIGS. 12A and 12B illustrate another embodiment with two transom extensions from the transom of a boat, where the hull of the boat is incorporated into the running surfaces of the transom extensions.
Figure 12A:
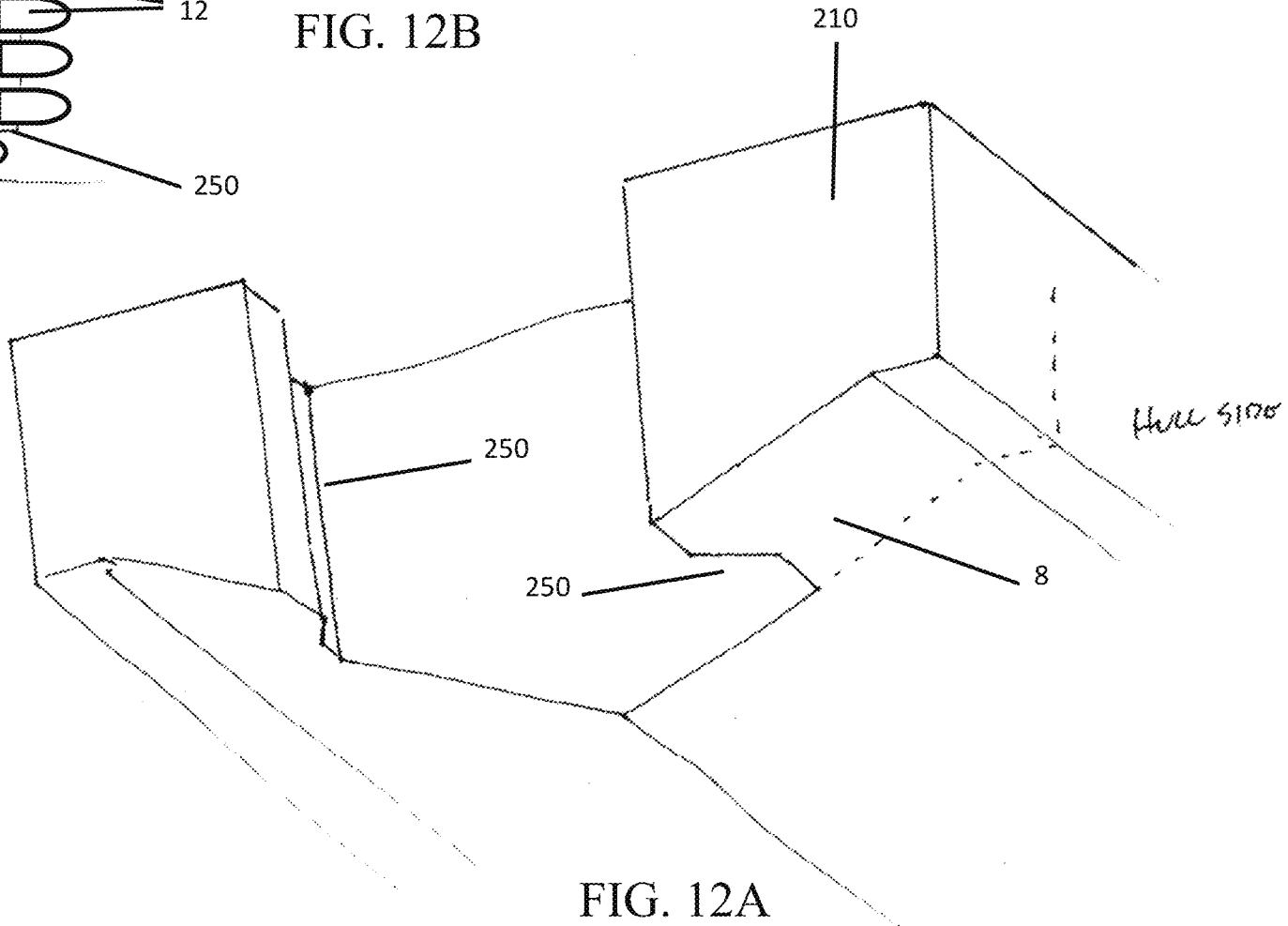
Figure 13:
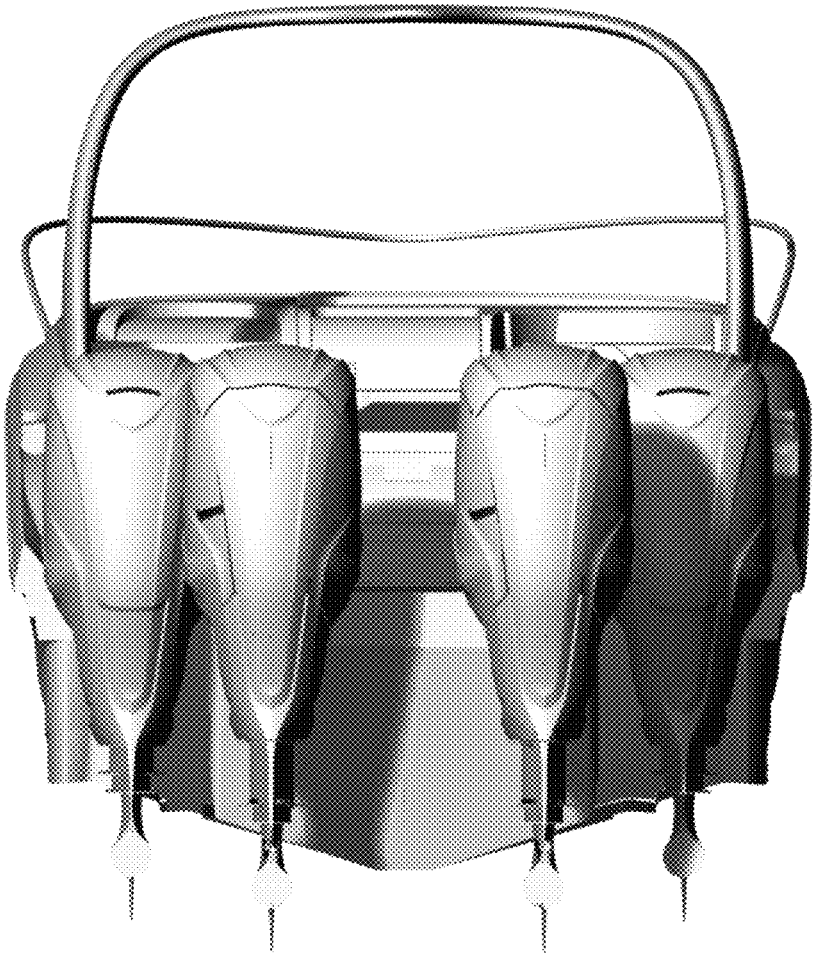
FIG. 13 is a stern view showing the engine cowlings overlapping.

In other embodiments, a plurality of secondary transom extensions 200 are arranged on a boat. For example, dual secondary engine mount transom extensions can be arranged such that one is at each of port and starboard sides of the transom, or one to each side of the centerline 45 of the boat. Dual transom extensions allow for at least one engine to be mounted therebetween on the primary engine mount transom 255. FIGS. 10, 11A, and 12A illustrate examples of dual secondary transom extensions arranged to either side of the centerline 45 and at the port and starboard sides on the primary transom. Dual secondary transom extensions can also be arranged to either side of and closer to the center line, yet still allow for the mounting of an engine therebetween on the primary transom. This is not shown in the Figures, but is understood by a person of skill in the art. Use of more than two transom extensions, for example three or four, on a single boat is also possible if the boat is large enough. Although not depicted here, this is readily apparent to one skilled in the art.

Figures 7A, 7B, 7C:
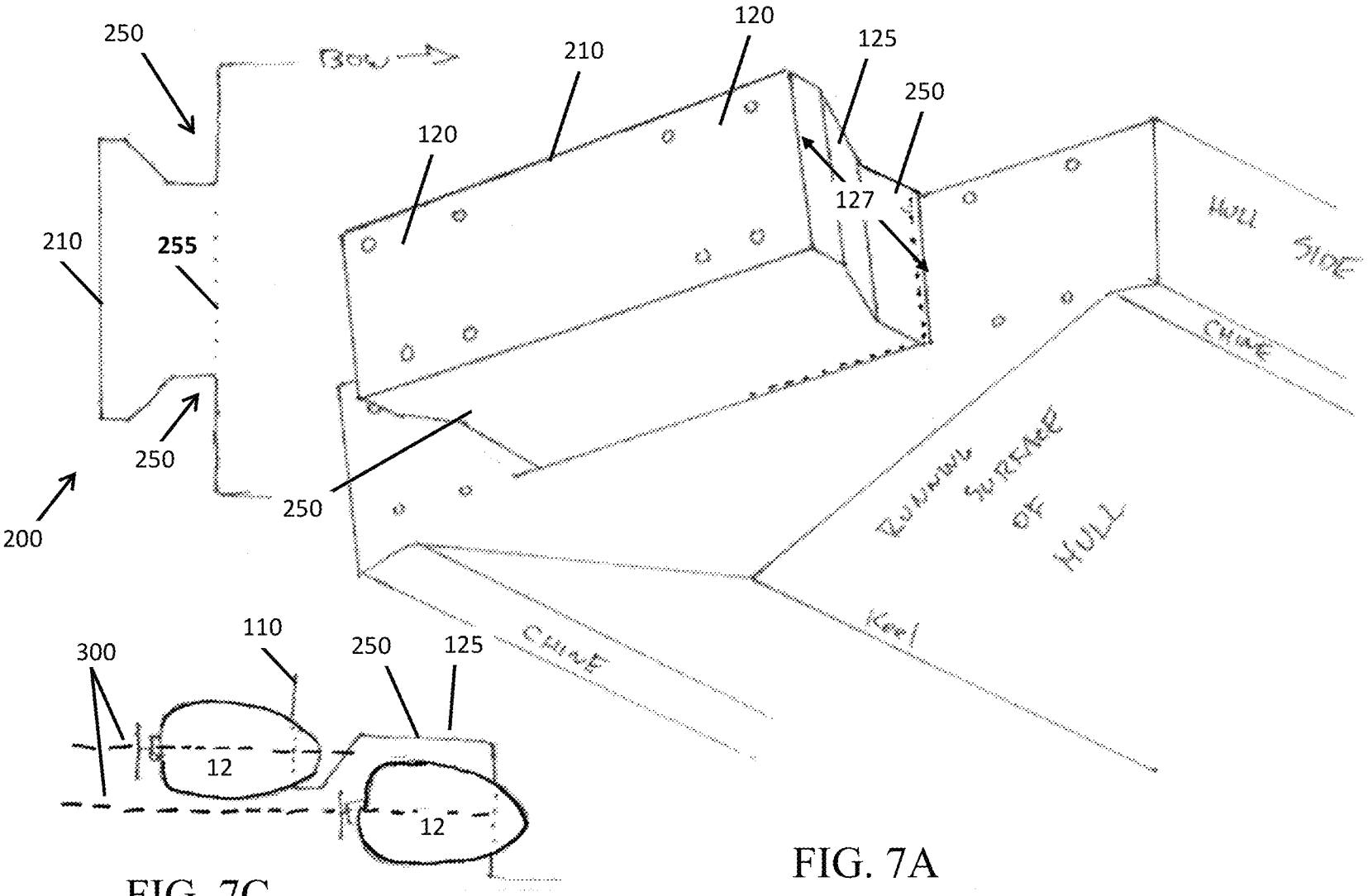
FIGS. 7A, 7B, and 7C illustrate the stern of a boat with another embodiment of a staggered transom. In this embodiment, there is a single secondary transom extension with engine pods on either side.
Figures 8A, 8B:
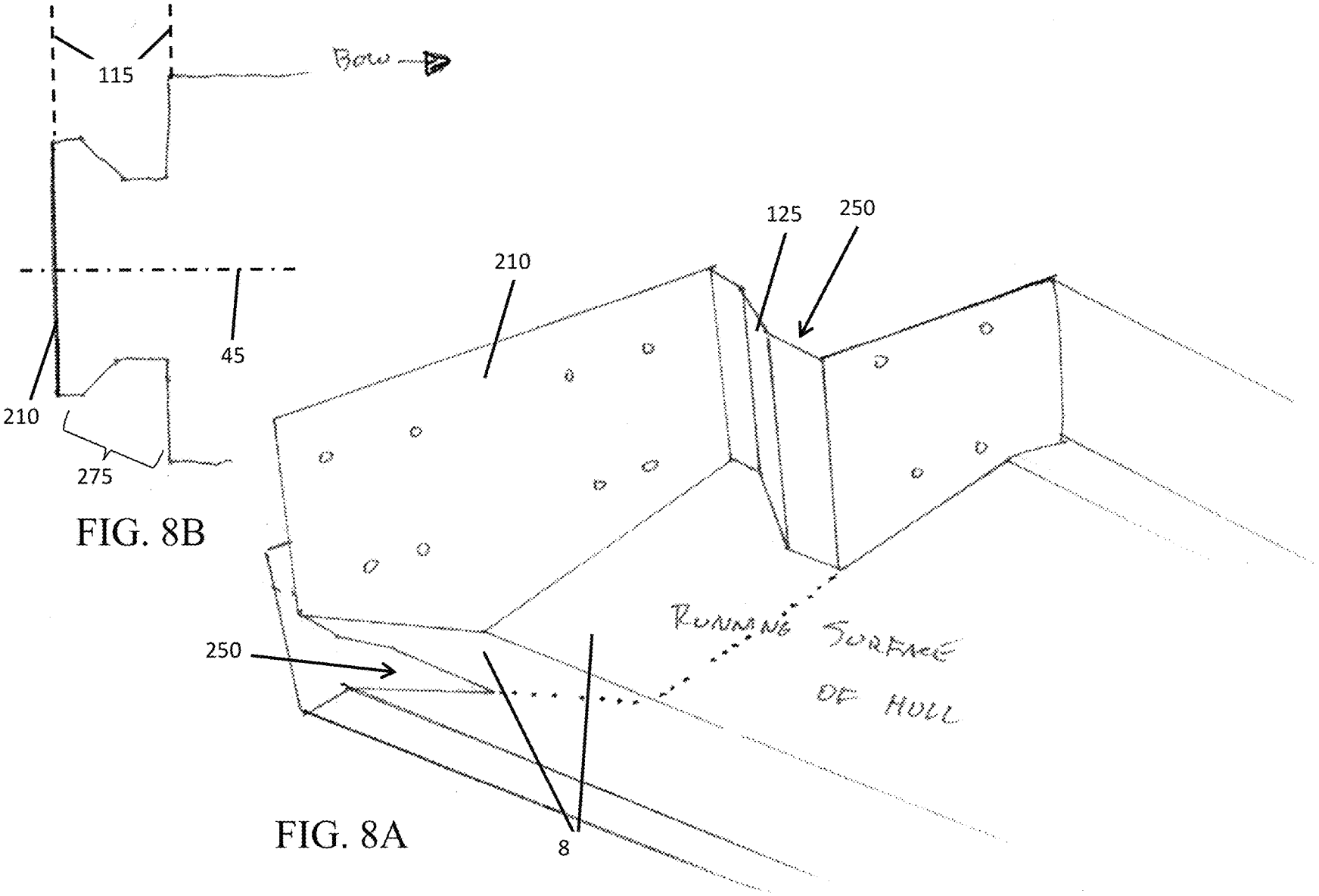
FIGS. 8A and 8B illustrate yet another embodiment of a staggered transom. In this embodiment, there is a single secondary transom extension with engine pods on either side and the boat hull is incorporated into the running surface of the secondary transom extension.

The center line of propulsion 300 is the direction of the force created by the outboard engine thrust mechanism. There two main types of thrust mechanisms used on deep V-hull boats: jet power and propeller, with propeller being the most common. There is a considerable amount of information available regarding propeller propulsion and the optimum configuration and placement of propellers. Typically, outboard engine propellers placed side by side can operate with about 2 inches to about 4 inches between the tips of the blades of the propellers. It is usually not possible to arrange propellers this close together because the large powerheads of outboard engines require that they be placed further apart on the transom. Advantageously, the engines mounted on a secondary transom extension 200 and the engines mounted on a primary transom 255 are in different transom planes 115, as depicted, for example, in FIGS. 8B and 9A. This allows the operating widths 25 of the engines to be overlapped, positioning the propellers and their respective centerlines of propulsion 300 closer together, as depicted in FIGS. 4, 7C, and 11B. Staggering the engines on different transom planes also allows more engines to be mounted on the boat.

To further increase the space available on a primary engine mount transom 255, the secondary transom extension can be configured with one or more engine pods 250 between the transom 255 and the transom section 210. An engine pod is an indentation or cut-out 275 where the secondary transom extension 200 can be narrower than a transom section 210, where it attaches to or extends from the primary transom 255. Alternatively, an engine pod can be formed when the transom section overlaps the supports, as described above and shown in FIG. 6B. An outboard engine can be operably attached to the transom with the housing 32 disposed within an engine pod, such as shown in FIGS. 7C and 11B, which can position the engine cowling 12 above the engine pod. This can bring the engine center lines and, consequently, the center lines of propulsion 300 of engines mounted on the primary transom 255 and the secondary transom extension 200 closer together.

Each transom extension 200 can have an engine pod 250 on either or both sides of the transom extension, examples of which are shown in FIGS. 6-9, 11, and 12. If two or more transom extensions are utilized, there can be at least one engine pod configured on each. For example, the two transom extensions can be on the port and starboard sides, respectively, optionally with engine pods open towards or facing the centerline 45, an example of which is shown in FIGS. 9A, 9B, 12A and 12B.

Outboard engines can be more advantageous that inboard engines on a boat. Increasing power and speed requires mounting more outboard engines on the boat. The number of outboard engines that can be attached was limited by the length of the transom. A transom extension of the subject invention allows more outboard engines to be attached to boat than could be attached the transom alone. This can be particularly desirable on larger boats on which it is advantageous to use outboard engines, but the width of the transom limits the number of engines that can be employed. By providing an additional transom section in a different transom plane than the transom of the boat, more engines can be mounted on the boat.

All patents, patent applications, provisional applications, and other publications referred to or cited herein are incorporated by reference in their entirety, including all figures and tables, to the extent they are not inconsistent with the explicit teachings of this specification. Additionally, the entire contents of the references cited within the references cited herein are also entirely incorporated by reference.

The examples and embodiments described herein are for illustrative purposes only and that various modifications or changes in light thereof will be suggested to persons skilled in the art and are to be included within the spirit and purview of this application.

Any reference in this specification to "one embodiment," "an embodiment," "example embodiment," "further embodiment," "alternative embodiment," etc., is for literary convenience. The implication is that any particular feature, structure, or characteristic described in connection with such an embodiment is included in at least one embodiment of the invention. The appearance of such phrases in various places in the specification does not necessarily refer to the same embodiment. In addition, any elements or limitations of any invention or embodiment thereof disclosed herein can be combined with any and/or all other elements or limitations (individually or in any combination) or any other invention or embodiment thereof disclosed herein, and all such combinations are contemplated with the scope of the invention without limitation thereto.

What is claimed is:

1. A boat comprising:

a hull having a stern;

a transom at the stern of the hull;

a transom extension, extending from the transom, comprising, a support extending from the transom, a transom section arranged on the support, and a running surface below the support and/or the transom section, such that the transom and the transom section have different transom planes:

a first engine mounted on the transom; and a second engine mounted on the transom section, such that the second engine is farther aft than is the first engine.

2. The boat according to claim 1, wherein the transom section overlaps the at least one support.

3. The boat according to claim 1, comprising two supports, one support arranged at each of port and starboard sides of the transom section.

4. The boat according to claim 1, wherein the transom extension is centered on the transom of the boat.

5. The boat according to claim 1, wherein the transom extension is to one side of a centerline, either port or starboard, of the boat.

6. The boat according to claim 5, further comprising another transom extension located on the other side of the centerline of the boat.

7. The boat according to claim 1, wherein the hull of the boat is integral with the running surface.

8. The boat according to claim 1, further comprising at least one engine pod between the transom and the transom section, wherein there is at least one engine in the engine pod when the boat is in a running configuration.

9. The boat according to claim 8, wherein the transom extension is centered on the transom and comprises an engine pod on a port side of the transom extension and an engine pod on a starboard side of the transom extension.

10. The boat according to claim 8, comprising a first transom extension to a port side of a centerline of the boat with an engine pod open towards the centerline and a second transom extension to the starboard side of the centerline with an engine pod open towards the centerline.

11. The boat according to claim 1, wherein an operating width of a cowling of the first engine overlaps with an operating width of a cowling of the second engine.

12. The boat according to claim 11, wherein the transom section overlaps the at least one support.

13. The boat according to claim 11, comprising two supports, one support arranged at each of port and starboard sides of the transom section.

14. The boat according to claim 11, wherein the transom extension is centered on the transom of the boat.

15. The boat according to claim 11, wherein the transom extension is to one side of a centerline, either port or starboard, of the boat.

16. The boat according to claim 15, further comprising another transom extension located on the other side of the centerline of the boat.

17. The boat according to claim 11, wherein the hull of the boat is integral with the running surface.

18. The boat according to claim 11, further comprising at least one engine pod between the transom and the transom section, wherein there is at least one engine in the engine pod when the boat is in a running configuration.

19. The boat according to claim 18, wherein the transom extension is centered on the transom and comprises an engine pod on a port side of the transom extension and an engine pod on a starboard side of the transom extension.

20. The boat according to claim 18, comprising a first transom extension to a port side of a centerline of the boat with an engine pod open towards the centerline and a second transom extension to a starboard side of the centerline with an engine pod open towards the centerline.

* * * * *